US009960492B2

(12) United States Patent
Cobos Reyes et al.

(10) Patent No.: US 9,960,492 B2
(45) Date of Patent: May 1, 2018

(54) ANTENNA AND METHOD FOR PRODUCING ANTENNAS

(71) Applicant: PREMO, SL, Campanillas (Málaga) (ES)

(72) Inventors: Sergio Cobos Reyes, Málaga (ES); Francisco Ezequiel Navarro Pérez, Bobadilla Estación Antequera (ES); Antonio Rojas Cuevas, Málaga (ES); Maria Del Mar Villarrubia García, Málaga (ES); Claudio Cañete Cabeza, Torremolinos (ES)

(73) Assignee: PREMO, S.L., Campanillas (Málaga) (ES)

( * ) Notice: Subject to any disclaimer, the term of this patent is extended or adjusted under 35 U.S.C. 154(b) by 95 days.

(21) Appl. No.: 15/120,939

(22) PCT Filed: Feb. 24, 2015

(86) PCT No.: PCT/ES2015/000025
§ 371 (c)(1),
(2) Date: Aug. 23, 2016

(87) PCT Pub. No.: WO2015/128518
PCT Pub. Date: Sep. 3, 2015

(65) Prior Publication Data

US 2016/0365636 A1 Dec. 15, 2016

(30) Foreign Application Priority Data

Feb. 25, 2014 (EP) ..... 14380009

(51) Int. Cl.
*H01Q 7/06* (2006.01)
*H01Q 1/12* (2006.01)
*H01F 3/00* (2006.01)

(52) U.S. Cl.
CPC ..... *H01Q 7/06* (2013.01); *H01Q 1/12* (2013.01); *H01F 2003/005* (2013.01)

(58) Field of Classification Search
CPC .. H01Q 7/08; H01Q 7/06; H01Q 7/00; H01Q 1/3241; H01Q 1/12; H01F 2003/005
See application file for complete search history.

(56) References Cited

U.S. PATENT DOCUMENTS 7,755,558 B2 7/2010 Ueda et al.
8,451,184 B2 5/2013 Murakami

FOREIGN PATENT DOCUMENTS

EP 1 315 178 A1 5/2003
JP 2013165368 A 8/2013

OTHER PUBLICATIONS

European Search Report of European priority application No. 14380009.2 dated Aug. 26, 2016.

(Continued)

*Primary Examiner* — Robert Karacsony

(57) ABSTRACT

The present invention relates to an antenna and a method of manufacturing antennas.
The antenna comprises: —a magnetic core (1); —one or more windings (2, 3) arranged around the core (1); —and an electrically insulating base on which the magnetic core (1) provided with the winding or windings (2, 3) is arranged, the electrically insulating base integrating electrically conductive elements (20) provided for being connected to the windings (2, 3), where the electrically insulating base comprises two parts (5, 6) which are arranged in parallel, facing one another, and linked to the magnetic core (1). Each of the two parts (5, 6) provides a support portion, which support portions together constitute a support around the outer perimeter of which there is wound an external winding (4).

(Continued)

The method comprises manufacturing the antenna of the invention by sequentially winding all the windings with a multi-axis winding machine.

19 Claims, 8 Drawing Sheets

(56) References Cited

OTHER PUBLICATIONS

International Search Report and written opinion of PCT application No. PCT/ES2015/000025 dated Jun. 9, 2015.
IPRP of PCT application No. PCT/ES2015/000025 dated Feb. 5, 2016.

ANTENNA AND METHOD FOR PRODUCING ANTENNAS

This application is the US national phase application of international application number PCT/ES2015/000025, filed 24 Feb. 2015, which designates the US and claims priority to EP Application No. 14380009.2 filed 25 Feb. 2014, the contents of each of which are hereby incorporated by reference as if set forth in their entireties.

TECHNICAL FIELD

In a first aspect, the present invention relates to an antenna comprising an electrically insulating base split into two parts on which there is arranged a low coercivity magnetic core and two or more windings wound on said core, and more particularly to an antenna where the two parts of the base provide an electrically insulating support for winding one of the windings of the antenna.

A second aspect of the invention relates to a method of manufacturing antennas which comprises manufacturing the antenna of the first aspect by sequentially winding all the windings with a multi-axis winding machine.

STATE OF THE ART

Antennas formed by an electrically insulating base defining a housing for a one-piece magnetic core around which two windings are wound according to two axes orthogonal to one another, where the base itself defines, in its perimeter, a reel for winding a third external winding around it according to a third axis orthogonal to the other two axes, are known through U.S. Pat. No. 7,755,558B2, for example.

On the other hand, U.S. Pat. No. 8,451,184B2 discloses in the section on the state of the art (see FIG. 9 of the drawings) an antenna formed by a one-piece core on which three windings are wound, particularly two of them around a central part of the core, according to two orthogonal X- and Y-axes, and an external winding wound according to a Z-axis around a perimetral part of the core formed by four reel portions separated by the areas of passage of the X and Y windings.

U.S. Pat. No. 8,451,184B2 criticizes such arrangement due to the problem involving the effect of the different windings arranged in this manner and the dimensional and geometric requirements of the common core on the characteristics of the different coils and on the capacitive couplings between windings. As a solution to such problem, U.S. Pat. No. 8,451,184B2 proposes an antenna formed by a first coil formed by an electrically insulating base split into two parts defining a housing for a first core around which two windings are wound according to two orthogonal X- and Z-axes, one in a central part of the core and the other in a groove of a perimetral part thereof, running as a discontinuous reel, and a second coil formed by a second magnetic core around which another winding is arranged according to a Z-axis, and arranged adjacent to the first coil (see FIG. 6), both coils being integrated by resin molding.

Although the solution provided by U.S. Pat. No. 8,451,184B2 constitutes, according to the inventors thereof, an antenna that may be dimensionally smaller or thinner than conventional three-axis antennas, having two cores separated from one another clearly makes the dimension according to the direction of separation of the cores greater than if only one core was used. The sensitivity range, particularly of the coil according to the Z-axis, as well as the coupling capacitances, particularly the coupling capacitance formed between the Z and Y coils, can certainly be improved.

Patent document JP2013165368A proposes an antenna formed by a one-piece core such as the one criticized in the state of the art of U.S. Pat. No. 8,451,184, i.e., a core common for the three windings, and it further proposes arranging the core with the three windings on an electrically insulating base formed by four different corner portions separated from one another which, in this case, do not define a housing for the core but rather simply a support for the core, particularly for the base of the mentioned four reel portions.

Therefore, JP2013165368A does not solve, nor does it even consider, the problem described in U.S. Pat. No. 8,451,184B2 with respect to the drawbacks of using such core for winding the three windings in terms of capacitive couplings and deterioration of the characteristics of the coils.

EP1315179A reveals a three dimensional winding arrangement having an arrangement of three coils whose axes are mutually orthogonal and intersect at a permanent point. A cubic coil bearer has raised corners with the distances between the surfaces of the raised corners and the cube surfaces corresponding at least to the coil thickness. Spaces are left between raised edges for feeding or inserting windings.

DESCRIPTION OF THE INVENTION

There is a need to offer an alternative to the state of the art covering the gaps found therein by providing a very small-sized antenna that performs better than the known antennas, particularly in terms of sensitivity, reduced capacitive coupling between coils, ease of manufacturing, etc.

With such purpose, in a first aspect the present invention relates to an antenna comprising:

- at least one magnetic core;
- one or more windings wound around said magnetic core; and
- an electrically insulating base on which said magnetic core provided with said winding or windings is arranged, said base integrating electrically conductive elements provided for being connected to said winding or windings, where said electrically insulating base comprises two parts which are arranged in parallel, facing one another, and linked to said magnetic core.

Unlike known antennas, in the antenna proposed by the first aspect of the invention, each of the mentioned two parts of the electrically insulating base provides a support portion, which support portions together constitute a support around the outer perimeter of which there is wound an external winding.

The magnetic core is generally a ferrite core which, according to an embodiment, comprises a material selected from the group consisting of cobalt, nickel-zinc alloy, manganese-zinc alloy, amorphous cobalt and nanocrystalline cobalt.

According to a preferred embodiment, each of said two parts has protuberances in two distal end portions, each of which includes two walls which form a corner and constitute said support portions, such that said two parts provide four corners which are located at the vertices of a quadrangular perimeter, facing one another through inner faces, internally demarcating a housing for said magnetic core, and the outer faces of the four corners define said outer perimeter around which said external winding is wound.

For an embodiment, each of said two support portions comprises a C-shaped wall including two corners, such that the inner faces of the two walls are facing one another, internally demarcating a housing for the magnetic core, and the outer faces of the two walls define said outer perimeter around which said external winding is wound.

The mentioned link between the two parts and the magnetic core is generally made by means of attachment of a basal area of the magnetic core on surfaces of said parts, which are separated, using a structural adhesive.

According to an embodiment, the two parts forming the base are identical and symmetrical, made of an electrically insulating plastic material, and the mentioned electrically conductive elements are embedded in the mentioned parts and protrude from distal and/or lateral end portions thereof as projections or terminals.

According to an embodiment, the mentioned distal end portions have a rectangular prismatic configuration and are attached to one another by a straight segment with a uniform section as a strip, orthogonal to said walls, and providing the mentioned surfaces for the attachment of said basal area of the magnetic core.

According to an embodiment, said end portions of the two parts further include metal platings in a basal area for connection to a circuit by surface mounting.

For an embodiment, the external winding wound around the outer faces of at least the four corners is arranged against said outer faces without adhesive, and the wire forming this winding remains exposed to the environment.

According to a preferred embodiment, the antenna of the first aspect of the present invention integrates two windings wound on the magnetic core around respective coplanar, orthogonal X-, Y-axes, and a third external winding is wound around the mentioned outer perimeter of said support according to a Z-axis perpendicular to the two preceding axes.

For an embodiment, the magnetic core is a monolithic core and comprises a central part in the form of a quadrangular plate, having next to each of its four corners a prismatic turret protruding from the two larger faces of said central part, said turrets being linked in twos by strips, adjacent to opposite sides of the central part, said strips protruding slightly from the larger faces of said central part determining a step, said central part and said strips providing supports for corresponding windings (around the X- and Y-axes), which are spaced from one another, wound around respective coplanar, orthogonal axes and covered by an electrically insulating sheet.

Such step provides a separation between the windings according to the X- and Y-axes which reduces the capacitive coupling between axes without having to provide additional spacer elements such as polyester tape, kapton tape or the like, and allows improving operation by reducing crosstalk, as well as reducing costs.

With respect to the mentioned electrically conductive elements, according to an embodiment, these elements adopt the shape of projections protruding from one or more faces of the base and are provided for attachment with the end of one of the corresponding windings by means of welding. Each of said projections generally has a notch for winding the end of the winding around it before welding, the function of said notch being to prevent such end of the winding from slipping and coming out of the projection.

According to an embodiment, the antenna proposed by the first aspect of the invention comprises an adaptor arranged on the magnetic core integrating metal platings on a larger outer surface which continue on a side surface to establish contact with said electrically conductive elements of the parts of the electrically insulating base and with said metal platings of its larger outer surface which are intended for surface mounting of the antenna.

The walls of the support portions constituting the support around the outer perimeter of which there is wound an external winding have a thickness sized to keep the external winding separated a specific distance from the other winding or windings for minimizing stray capacitances and couplings between windings, whereby crosstalk and costs are reduced.

According to an embodiment, at least part of an upper free edge of each of the walls extends in cantilever manner, in the direction opposite the housing, forming at least one projection made of an electrically insulating material.

A second aspect of the invention relates to a method of manufacturing antennas which comprises manufacturing an antenna according to the first aspect of the invention by means of performing at least the following steps:

- introducing and fixing the magnetic core in a housing demarcated by the inner faces of the four corners of two separated parts of an electrically insulating base which have been obtained by injection molding on an intermediate element (a continuous metal strip) which provides the mentioned electrically conductive elements and keeps said two parts of the base attached to one another;
- separating, by cutting, said intermediate element from the two parts of the base attached to the core; and
- sequentially winding with a multi-axis winding machine the winding or windings on the core and the external winding around the outer faces of the four corners of the two parts of the base.

Keeping the two parts of the electrically insulating base attached to one another until the magnetic core is fixed thereto in the housing, particularly until the core adheres and the adhesive used is cured, means that both parts form an integral and planar assembly at all times assuring coplanarity.

The mentioned intermediate element is formed by portions of metal strips providing the mentioned electrically conductive elements which are embedded in the parts of the base and are finally cut such that said electrically conductive elements are defined protruding from the bases and constitute a small field shielding metal mass, compared to antennas with a complete base, improving the quality factor (Q) and sensitivity, reducing the mass (the metal mass as well as the mass of the base itself), which improves the drop test.

According to an embodiment of the method proposed by the second aspect of the invention, there are provided, generally from spools, long metal strips (commonly known as lead frames) with identical and equidistant fiducial holes which allow automatically centering/positioning elements in relation to same, and which provide the mentioned electrically conductive elements intended for being integrated in the parts of a plurality of bases, the injection molding of the parts of the base, the dispensing of adhesive thereon, the mounting of the core on the base and the process for the thermal curing of the adhesive for all the bases, being carried out. By keeping all the bases attached to one another using such metal strips, the problem of individual automatic feeding of the bases to the assembly line, as well as the drive, transport and centering thereof, is solved.

After the adhesive is cured, the metal strips are cut in order to split them into the mentioned portions of metal strips attaching the two pieces of a base, and the winding step is then performed.

When the manufactured antenna comprises three windings, two around the core and the external winding, according to the method of the second aspect of the present invention, the parts of the electrically insulating base used are those of the previously described preferred embodiment for which each of the two parts has protuberances in two distal end portions, each of which includes two walls forming a corner. In this case, the windings are first wound around the core according to axes orthogonal to one another, one of them passing through the gap existing between both parts and the other passing through the gap existing between the distal end portions of each part, below the segments that, as strips, join every two distal end portions to one another. Finally, the external winding is wound around the outer faces of the four corners.

For the less preferred case in which the antenna only comprises two windings, one around the core and the external winding, the parts of the electrically insulating base of the embodiment described above can also be used so that each support portion provided by each of the parts comprises at least one C-shaped wall including two corners, first winding the winding around the core in a direction parallel to the walls and passing through the gap existing between both parts, and then winding the external winding around the outer faces of the two C-shaped walls.

According to a preferred embodiment, the method comprises arranging the external winding against the outer faces of the four corners without adhesive, the wire forming this external winding being exposed to the environment, thus improving the quality factor (Q) as a result of the reduction of the diameter and length of the middle turn, and therefore of the dimensions and strength of the winding, because the wire is not a thermal adhesive wire, compared to that of the winding conventionally carried out with a thermal adhesive wire, whereby the selectivity and tuning are improved. Since the winding is smaller, its actual resonance frequency increases as the distributed capacitance of the winding decreases, whereby the frequency stability of the antenna is improved.

Since thermal adhesive wire is dispensed with, the winding process increases since there is no need to wait for the wire to adhere using a solvent or heat, which, along with the use of a high speed multi-axis winding machine, allows producing many antennas in a machine at the same time.

BRIEF DESCRIPTION OF THE DRAWINGS

The foregoing and other advantages and features will be better understood from the following detailed description of several embodiments in reference to the attached drawings which must be interpreted in an illustrative and non-limiting manner, in which.

DETAILED DESCRIPTION OF SEVERAL EMBODIMENTS

The attached drawings illustrate several embodiments of the antenna proposed by the present invention.

Particularly, FIGS. 1, 2, 12 and 14 illustrate the two parts 5, 6 into which the base of the antenna of the present invention is split, for three different embodiments, but having in common, among other aspects, the fact that the two parts 5, 6 forming the base are identical and symmetrical, are made of an electrically insulating plastic material, and have electrically conductive elements 20, as projections, embedded in the mentioned parts 5, 6 and protruding from distal and/or lateral end portions 5*a*, 5*b*, 6*a*, 6*b* thereof.

Figure 1:
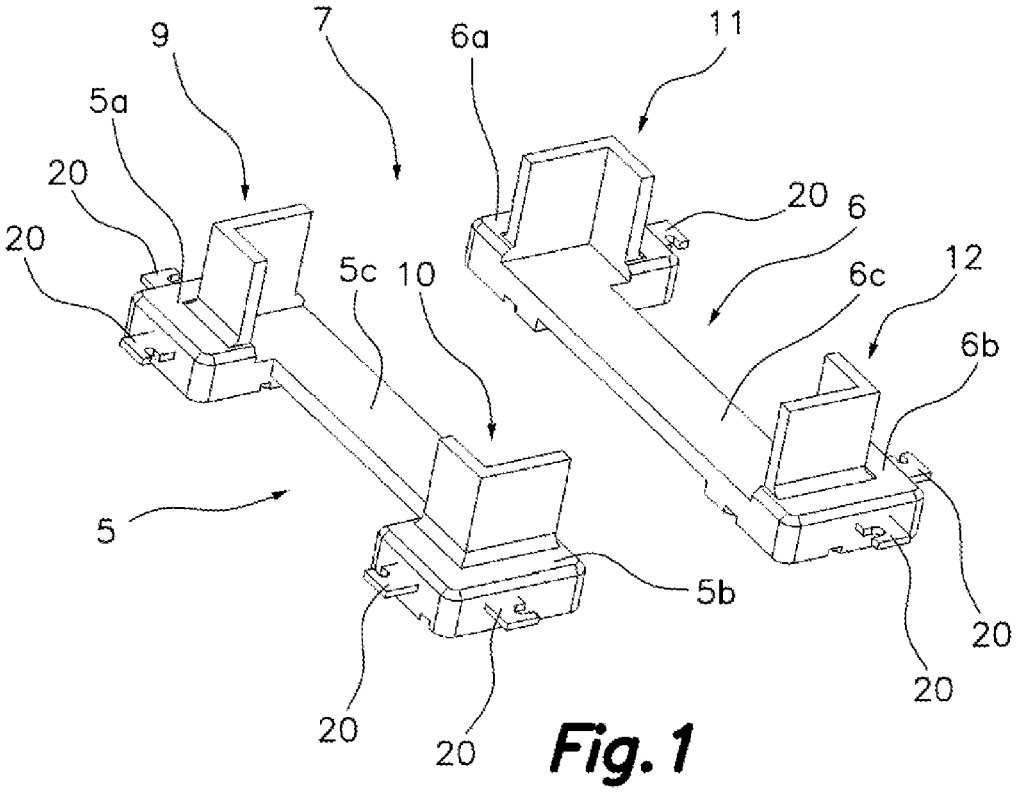
FIG. 1 is a top perspective view showing the two parts of the electrically insulating base of the antenna proposed by the first aspect of the present invention for an embodiment.
Figure 12:
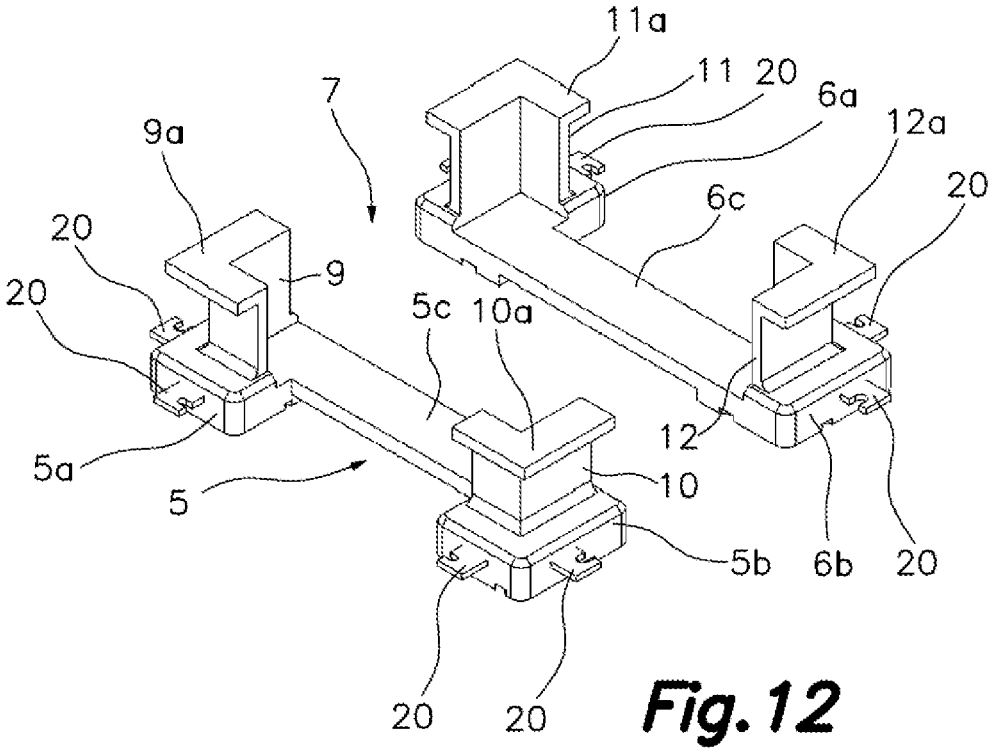
FIG. 12 is also a view similar to that of FIG. 1 but for an embodiment for which a projection or perimetral flange extends in cantilever manner from the upper edge of each corner out of the housing.
Figure 14:
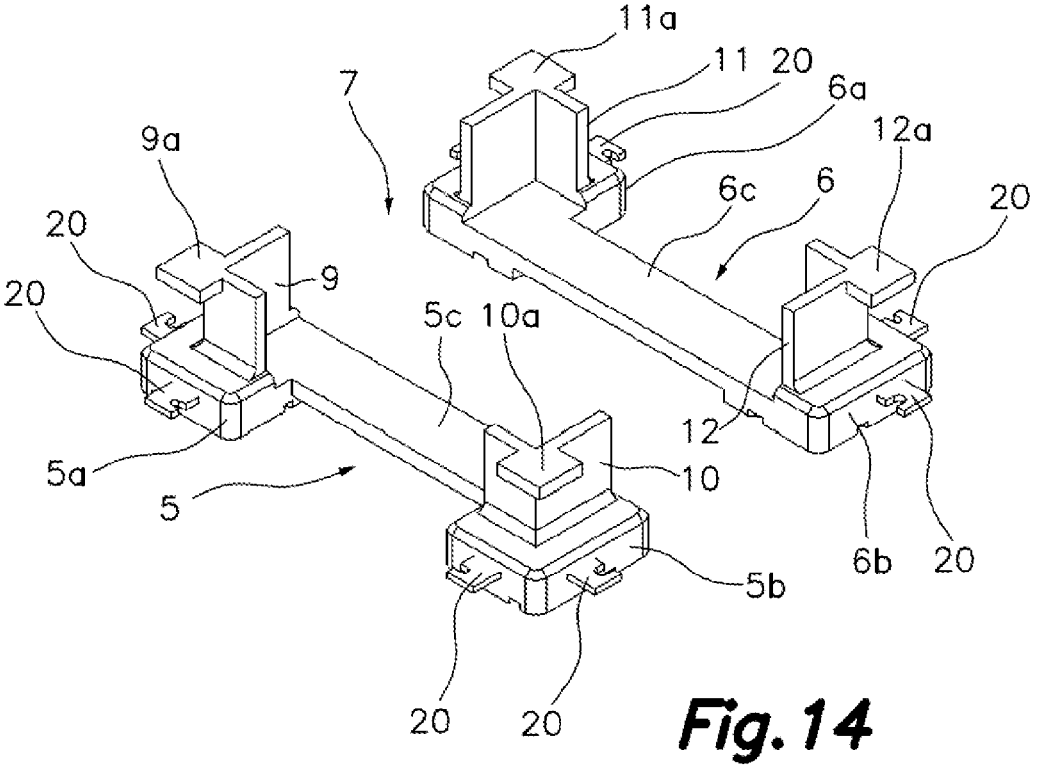
FIG. 14 shows an embodiment alternative to that of FIG. 12, differing from said FIG. 12 in that the projection extending in cantilever manner is smaller and does not extend from the entire perimeter of the upper edge of each corner.

For the embodiments of FIGS. 1, 12 and 14, each of the two parts 5, 6 has protuberances in two distal end portions 5*a*, 5*b*, 6*a*, 6*b*, each of which includes two walls forming a corner 9, 10, 11, 12, such that the two parts 5, 6 provide four corners 9, 10, 11, 12 which are located at the vertices of a quadrangular perimeter, facing one another through inner faces, internally demarcating a housing 7 for the magnetic core 1, and the outer faces of the four corners 9, 10, 11, 12 define an outer perimeter around which an external winding 4 is wound.

FIGS. 12 and 14 illustrate respective embodiments that differ from that of FIG. 1 in that they have projections 9*a*, 10*a*, 11*a*, 12*a* extending in cantilever manner from part of (in the case of FIG. 14) or from the entire (in the case of FIG. 12) upper edge of each corner 9, 10, 11, 12, out of the housing 7, in order to facilitate guiding while winding the external winding 4 and to prevent it from coming out by sliding.

Figure 13:
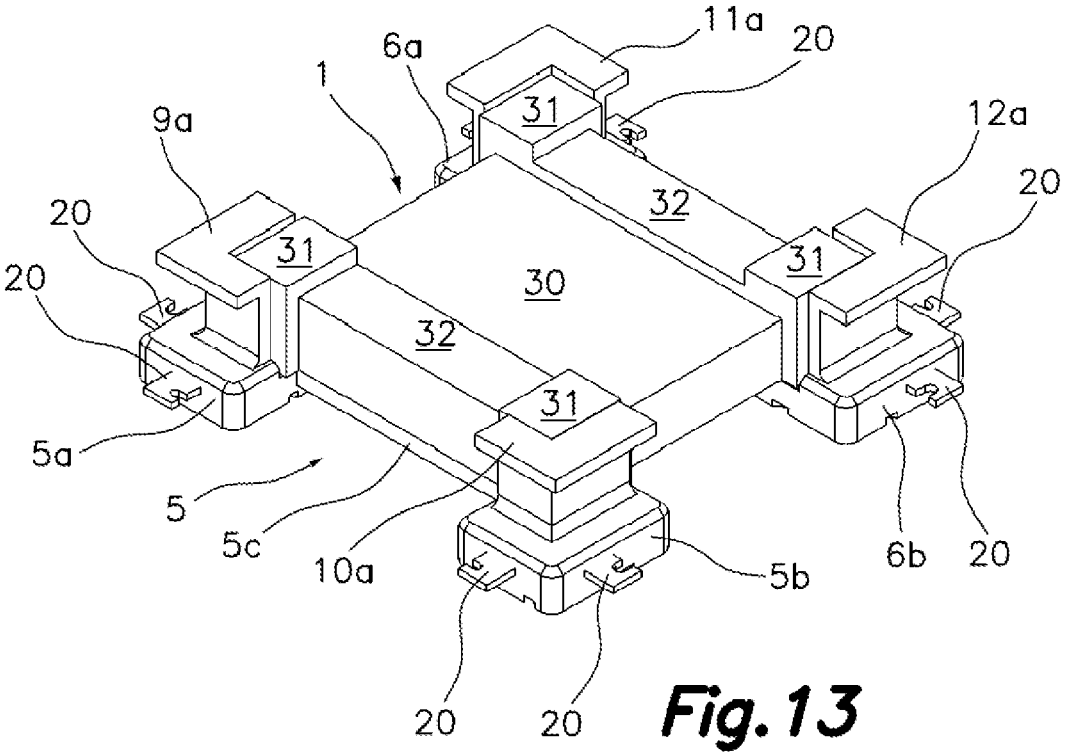
FIG. 13 shows a perspective view of the two parts of the base of FIG. 12 and the magnetic core fitted into the housing defined by the parts according to an embodiment of the proposed antenna.

FIG. 13 illustrates the same embodiment as FIG. 12 but once the magnetic core 1 has already been fitted into and fixed in the housing 7.

Figure 2:
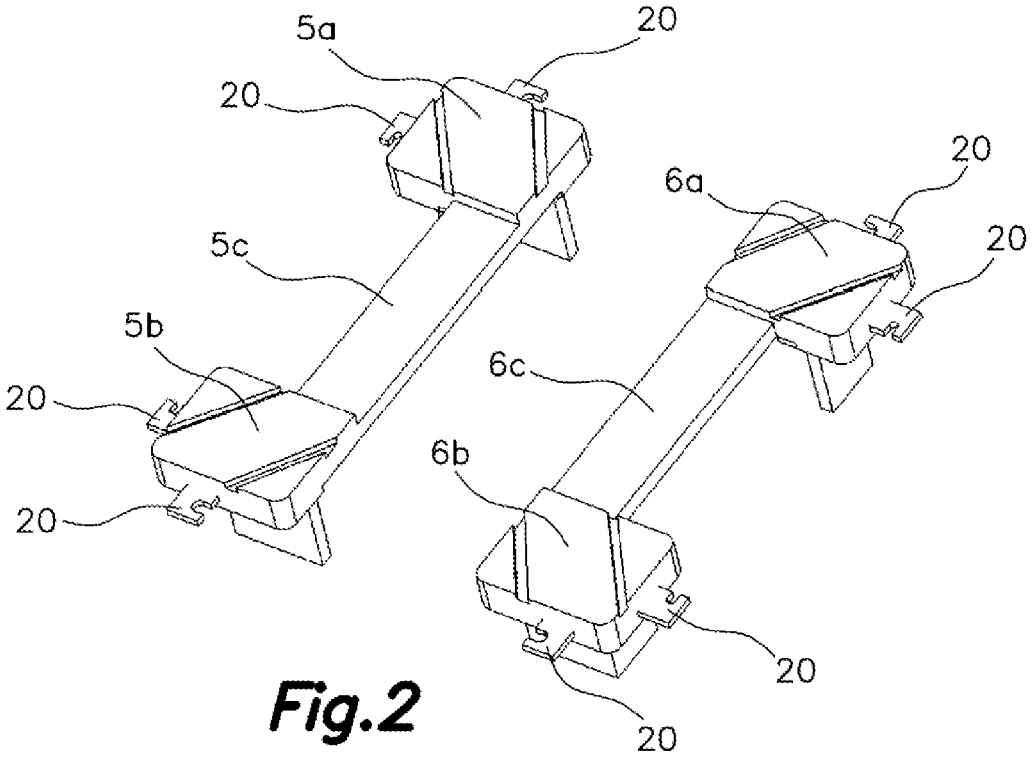
FIG. 2 shows the same elements as FIG. 1 but by means of a bottom perspective view.

FIG. 2 illustrates the two parts 5, 6 of FIG. 1 by means of a bottom view which allows observing how the distal end portions 5*a*, 5*b*, 6*a*, 6*b* have a rectangular prismatic configuration and are attached by a straight segment 5*c*, 6*c* with a uniform section as a strip, orthogonal to the walls forming said corners 9, 10, 11, 12, and providing attachment surfaces for the basal area of the magnetic core 1.

For a non-illustrated embodiment alternative to that of FIG. 2, the end portions 5*a*, 5*b*, 6*a*, 6*b* of the two parts 5, 6 further include metal platings in a basal area for connection to a circuit by surface mounting.

Figure 3:
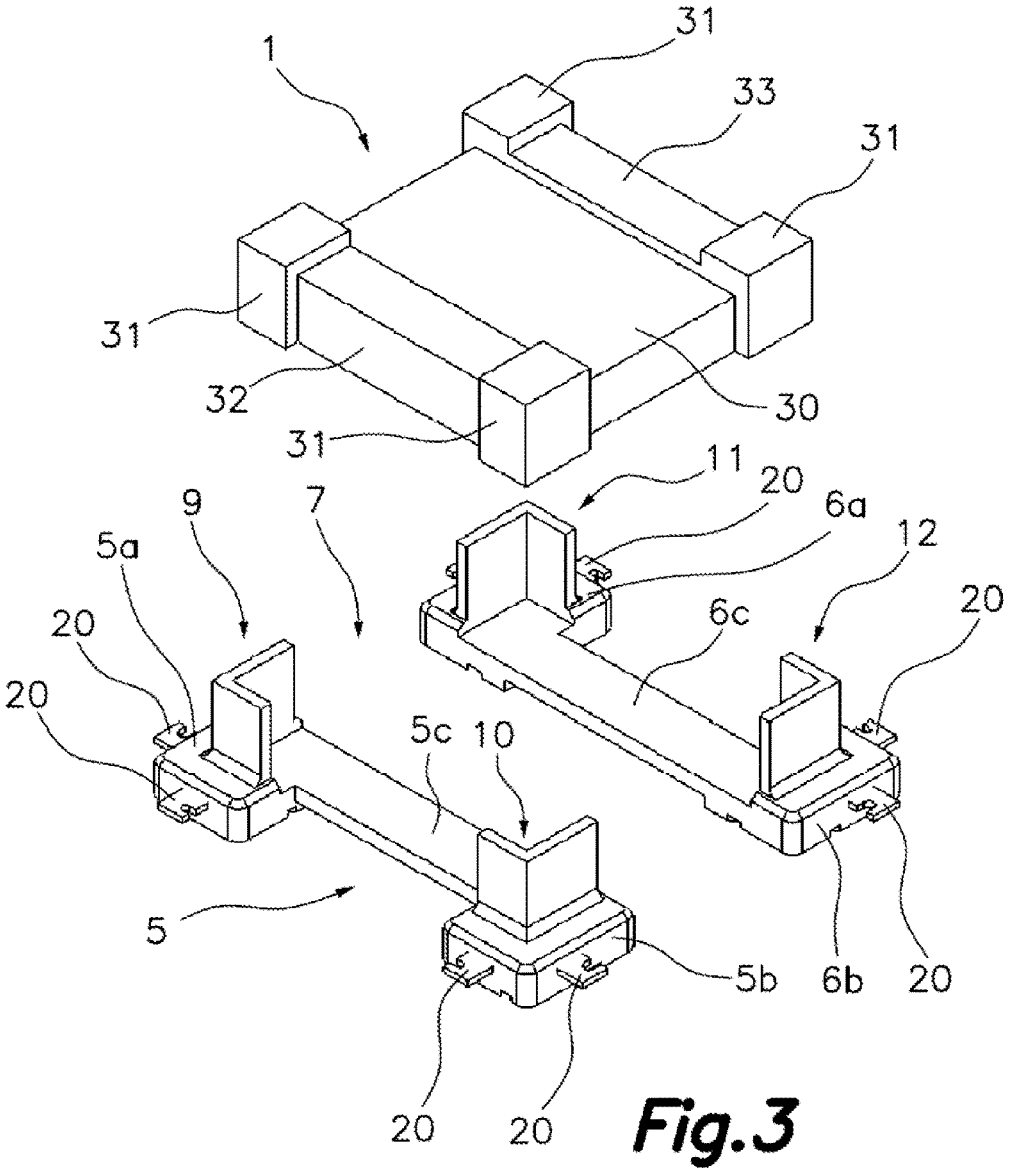
FIG. 3 shows an exploded perspective view of the two parts of the base of FIG. 1 and the magnetic core provided for fitting into the housing defined by same, according to an embodiment of the antenna proposed by the first aspect of the present invention.
Figure 4:
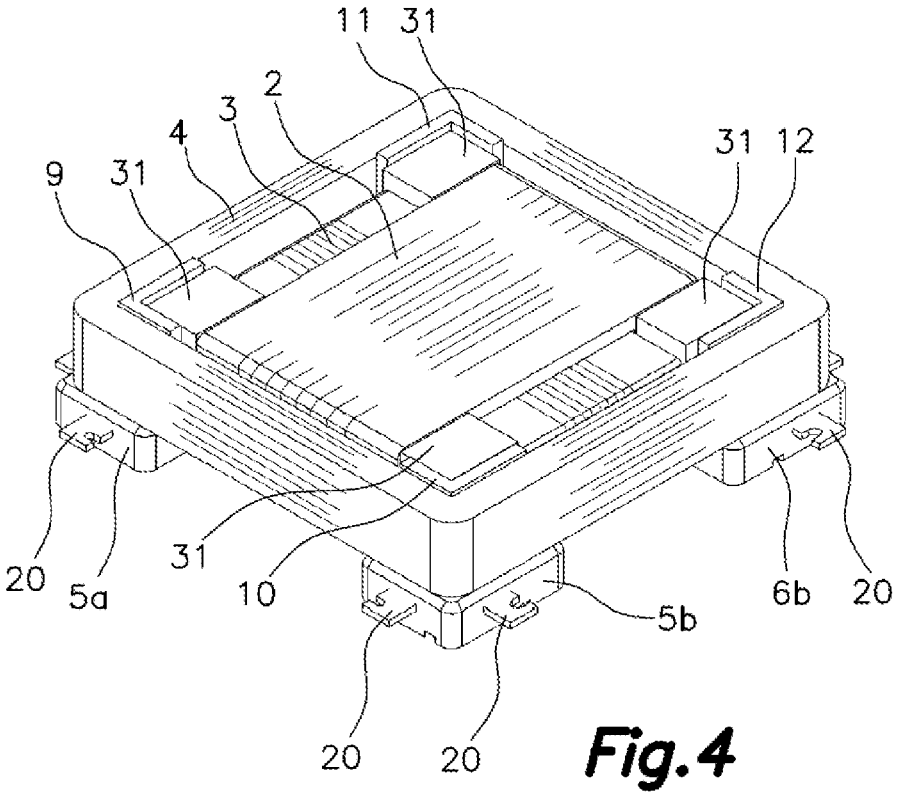
FIG. 4 shows a perspective view of the magnetic core once it is fitted into the housing defined by the two parts of the base with two windings wound around it and with an external winding wound around the corners of the walls protruding from the two parts of the base.

FIG. 3 shows the magnetic core 1 of the antenna of the present invention in a situation before it is fitted into and fixed in the housing 7 defined by the two parts 5, 6, according to the same embodiment as FIG. 1. It can be observed that the magnetic core 1 is a monolithic core and comprises a central part 30 in the form of a quadrangular plate, having next to each of its four corners a prismatic turret 31 protruding from the two larger faces of said central part 30, said turrets 31 being linked in twos by strips 32, 33, adjacent to opposite sides of the central part 30, said strips 32, 33 protruding slightly from the larger faces of said central part 30 determining a step 34, said central part 30 and said strips 32, 33 providing supports for the corresponding windings 2, 3, which are spaced from one another, wound around respective coplanar, orthogonal axes and protected by an electrically insulating sheet.

FIGS. 4, 5, 8 and 9 illustrate said two windings 2 and 3 wound around the core 1 and an external winding 4 wound around the four corners 9, 10, 11 and 12.

Figure 5:
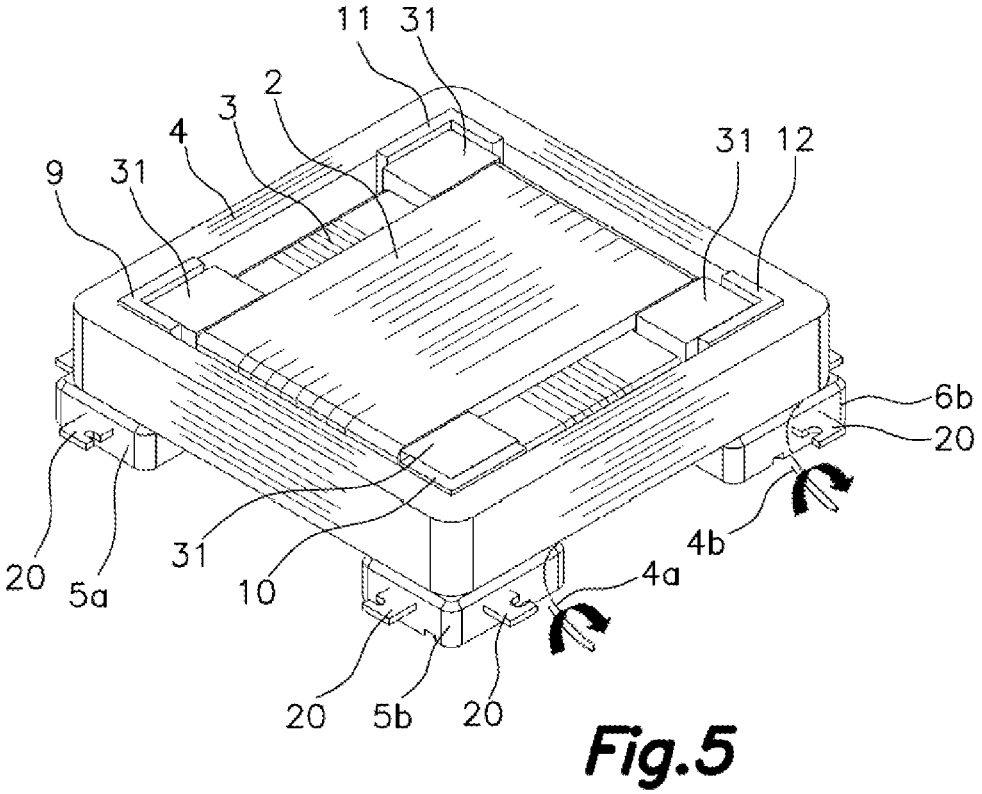
FIG. 5 differs from FIG. 4 in that it schematically shows how the ends of the windings are braided before connecting them to the illustrated metal projections.
Figure 6:
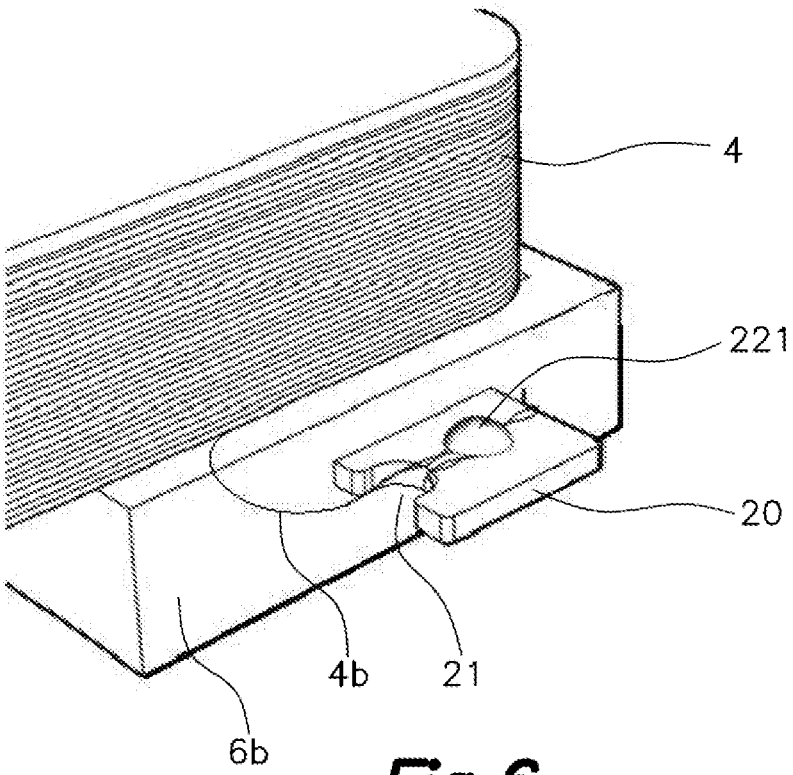
FIG. 6 shows in detail the connection of some of the ends of the winding illustrated in FIG. 5, once braided, to some of the metal projections by means of welding.

FIG. 5 illustrates how the end of the windings, in this case the ends 4*a* and 4*b* of the external winding 4, must be braided (as indicated by the illustrated arrows) before fixing it to a respective metal projection 20 or terminal, FIG. 6 illustrating the end 4*b* once it is braided, having been wound several times on the projection 20, passing through the notch 21 preventing it from slipping and coming out of the projection 20, and a welding point 221 having been applied to fix it to the projection 20.

Figure 7:
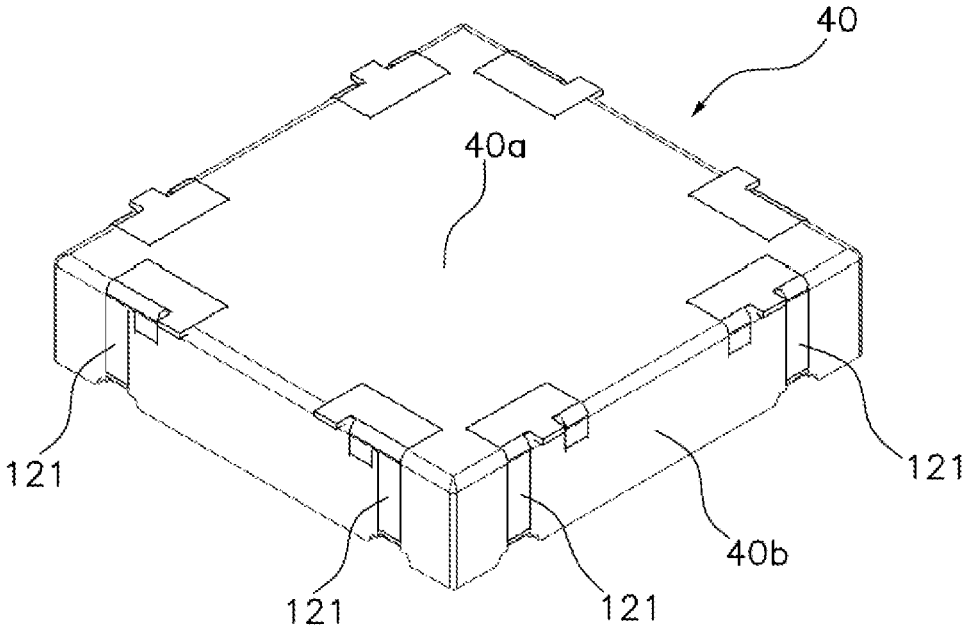
FIG. 7 illustrates a perspective view of an adaptor which is associated with the antenna proposed by the first aspect of the invention according to an embodiment, including metal platings on a larger outer surface which, when arranged on the magnetic core, contact the metal projections of the base, and which are intended for allowing the surface mounting of the antenna on a PCB board.
Figure 8:
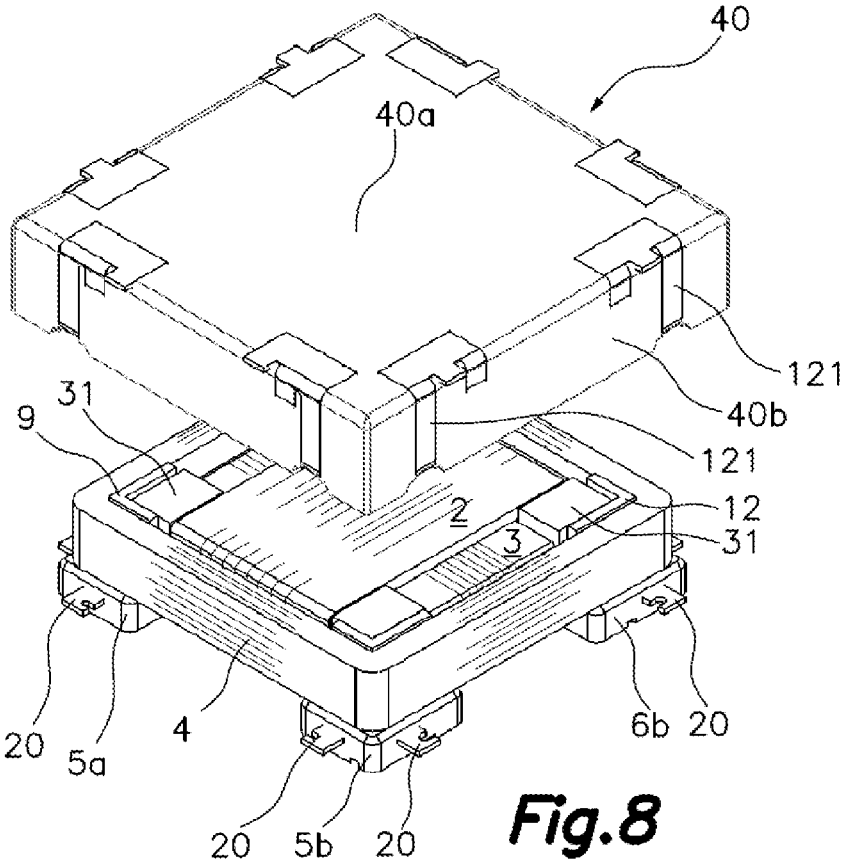
FIG. 8 shows an exploded top perspective view of the adaptor of FIG. 7 arranged for being mounted on the magnetic core, covering all the windings, and for being fixed to the base.

FIG. 7 shows an adaptor 40 comprised by the antenna proposed by the first aspect of the invention according to an embodiment, including metal platings 121 extending from a larger surface 40*a* to side surfaces 40*b* which, when arranged on the base-core assembly, contact the metal projections 20 of the base, and which are intended for the surface mounting of the antenna on a PCB board. FIG. 8 illustrates a situation before mounting the adaptor 40 on the base-core assembly, and FIG. 9 (bottom view) illustrates a situation once the adaptor is mounted and fixed thereto, once the free ends of the side extensions of the metal platings 121 contact some of the projections 20.

Figure 9:
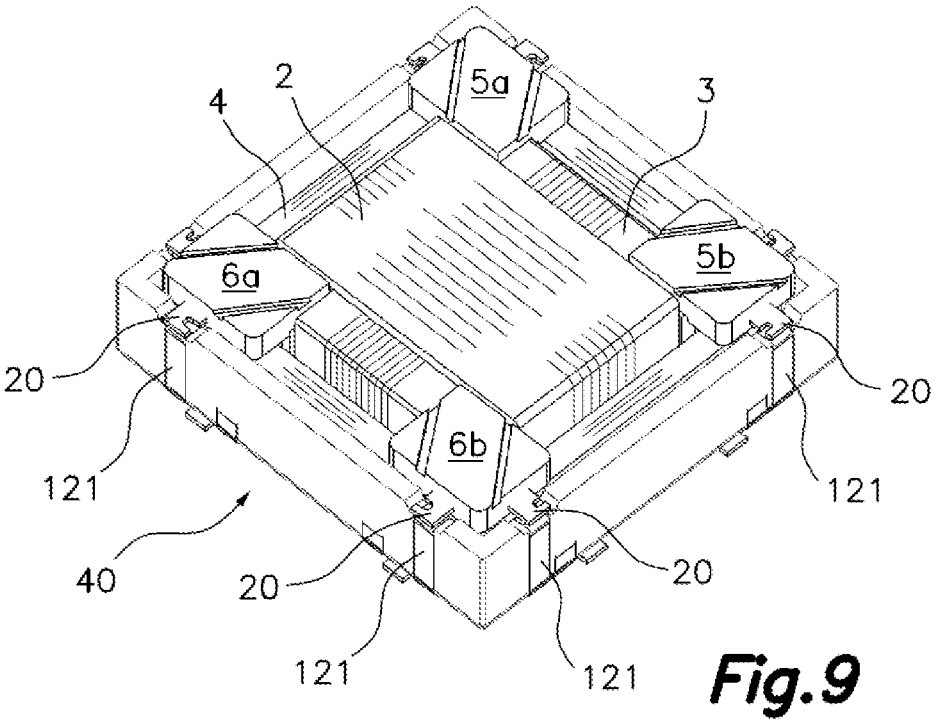
FIG. 9 shows a bottom perspective view of the adaptor once mounted on the magnetic core and fixed to the base.
Figure 10:
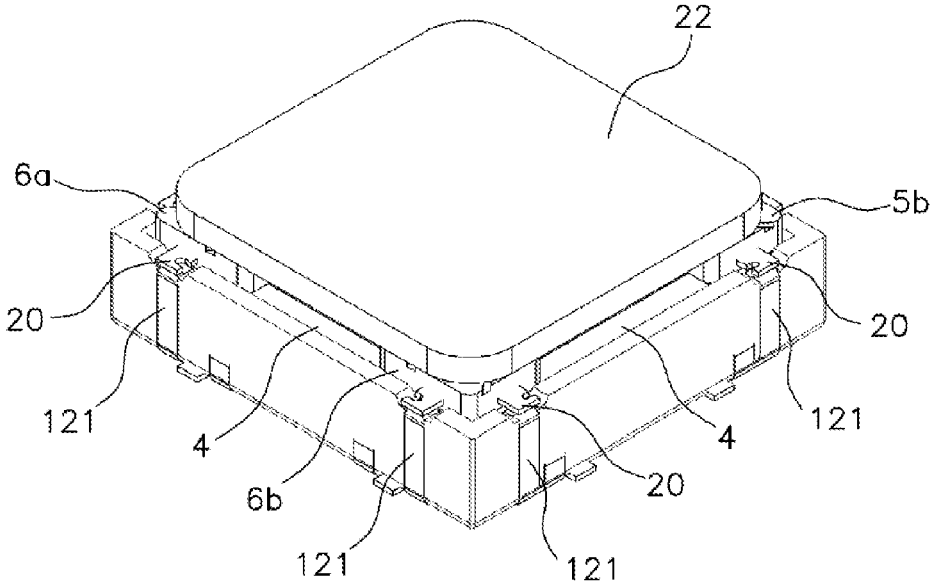
FIG. 10 differs from FIG. 9 in that it shows a label fixed on respective basal areas of the two parts of the base of the antenna proposed by the first aspect of the invention, for an embodiment.

FIG. 10 shows the addition of a protective label fixed on the basal areas of the two parts 5, 6 on the assembly illustrated in FIG. 9.

Figure 11:
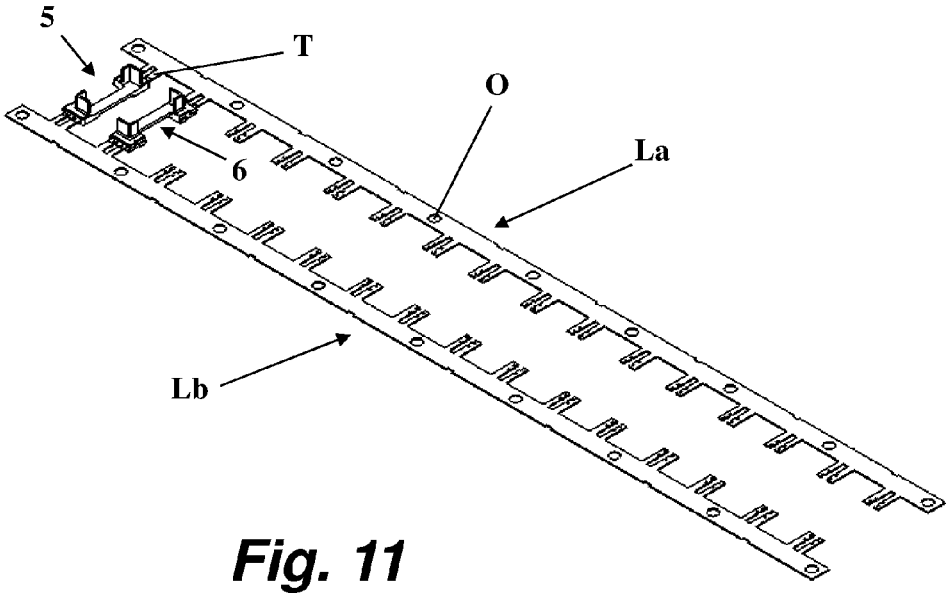
FIG. 11 shows an arrangement of two metal strips or lead frames arranged in parallel, integrating a plurality of metal terminals intended for being embedded in the electrically insulating parts of a plurality of bases of the antenna (which are injected molded on said metal strips in a known manner), the drawing illustrating only two parts of a base of an antenna, particularly of the antenna proposed by the first aspect of the invention, for an embodiment.

Finally, FIG. 11 illustrates an arrangement of two metal strips La, Lb, or lead frames, arranged in parallel, integrating a plurality of metal terminals T which are embedded in the electrically insulating parts (injection molded on said strips) of a plurality of antenna bases, the drawing illustrating only two parts 5, 6 of a base of an antenna, particularly of the antenna proposed by the first aspect of the invention, for an embodiment.

Such metal terminals T are cut, being separated from the metal strip La, Lb, once the magnetic core 1 has been fixed to the base, such that the portions which are separated from the strips La, Lb, i.e., those protruding from the ends of the parts 5, 6, define the metal projections 20.

Although FIG. 11 only illustrates the parts 5, 6 of a single base, the method proposed by the second aspect of the present invention applies to several metal strips La, Lb on which a plurality of parts 5, 6 of corresponding bases will be injection molded, a plurality of magnetic cores 1 finally being fixed thereto, one per base, and once they are all fixed, the different base-core assemblies formed are separated and part or all of them are wound in one and the same multi-axis winding machine simultaneously, or each of them separately, advantageously with the three windings 2, 3, 4.

A person skilled in the art may introduce changes and modifications in the embodiments described without departing from the scope of the invention as defined in the attached claims.

The invention claimed is:

1. An antenna comprising:

at least one magnetic core;

at least one winding wound around said magnetic core; and an electrically insulating base on which said magnetic core provided with said at least one winding is arranged, said electrically insulating base integrating electrically conductive elements connected to said at least one winding, where said electrically insulating base comprises at least two physically separated parts which are arranged, facing one another and providing a bottom seat attached to said magnetic core, wherein:

each of said two parts provides a support portion, said support portions together constituting a support around the outer perimeter of which there is wound an external winding; and each of said two parts has protuberances in two distal end portions, each of the protuberances including two walls which form a corner and constitute said support portions, whereby said two parts provide four corners, one gap existing between said distal end portions of each part, and another gap existing between both separated parts.

2. The antenna according to claim 1 wherein said four corners are located at the vertices of a quadrangular perimeter, facing one another through inner faces, internally demarcating a housing for said magnetic core, and the outer faces of the four corners define said outer perimeter around which said external winding is wound.

3. The antenna according to claim 1, wherein a link between the two parts and said magnetic core is made by means of attachment of a basal area of the core on surfaces of said parts, which are separated, using a structural adhesive.

4. The antenna according to claim 1, wherein said two parts forming the base are identical and symmetrical, made of an electrically insulating plastic material, and said electrically conductive elements are embedded in the two parts and protrude from distal and/or lateral end portions thereof.

5. The antenna according to claim 3, wherein said distal end portions have a rectangular prismatic configuration and are attached to one another by a straight segment with a uniform section, as a strip, providing the surfaces for the attachment of said basal area of the magnetic core.

6. The antenna according to claim 1, wherein said at least one winding comprises two windings wound on said magnetic core, around respective coplanar, orthogonal axes, and a third external winding wound around said outer perimeter of said support, according to an axis perpendicular to the two preceding axes.

7. The antenna according to claim 6, wherein said magnetic core is a monolithic core and comprises a central part in the form of a quadrangular plate, having next to each of its four corners a prismatic turret protruding from the two larger faces of said central part, said turrets being linked in twos by strips adjacent to opposite sides of the central part, said strips protruding slightly from the larger faces of said central part determining a step, said central part and said strips providing supports for corresponding windings, which are spaced from one another, wound around respective coplanar, orthogonal axes and protected by an electrically insulating sheet.

8. The antenna according to claim 1, wherein said electrically conductive elements adopt the shape of projections protruding from one or more faces of the base and are provided for attachment with the end of one of the corresponding windings by means of welding.

9. The antenna according to claim 1, further comprising an adaptor arranged on the magnetic core integrating metal platings on a larger outer surface adapted for surface mounting of the antenna, said metal platings continuing on a side surface to establish contact with said electrically conductive elements of the parts of the electrically insulating base.

10. The antenna according to claim 3, wherein said end portions of the two parts further include metal platings in a basal area for connection to a circuit by surface mounting.

11. The antenna according to claim 2, wherein the walls of said support portions have a thickness sized to keep the external winding separated a distance from the at least one winding for minimizing stray capacitances and couplings between windings.

12. The antenna according to claim 11, wherein at least one projection made of an electrically insulating material extends in cantilever manner from at least part of an upper free edge of each of said walls in the direction opposite the housing.

13. A method of manufacturing antennas, the method comprising manufacturing an antenna according to claim 1 by means of performing at least the following steps:

introducing and fixing said magnetic core in a housing demarcated by the inner faces of the four corners of the two physically separated parts of said electrically insulating base which have been obtained by molding on an intermediate element, as a metal strip, which provides said electrically conductive elements and keeps said two parts of the base attached to one another;

cutting or eliminating said intermediate element which keeps the two parts of the electrically insulating base attached to one another, and sequentially winding with a multi-axis winding machine the at least one winding on the core and the external winding around the outer faces of at least the four corners wherein the at least one winding are first wound around the core according to axes orthogonal to one another, one of them passing through the gap existing between both parts and the other passing through the gap existing between distal end portions of each part, below segments that, as strips, join every two distal end portions to one another.

14. The method according to claim 13, further comprising arranging the external winding against said outer faces of at least the four corners without adhesive, the wire forming this external winding being exposed to the environment.

15. The method according to claim 13, further comprising associating with the antenna an adaptor integrating metal platings on a larger outer surface which are intended for surface mounting of the antenna, said metal platings continuing on a side surface to establish contact with said electrically conductive elements or terminals and welding said terminals to said metal platings of said adaptor.

16. The antenna according to claim 2, wherein a link between the two parts and said magnetic core is made by means of attachment of a basal area of the core on surfaces of said parts, which are separated, using a structural adhesive.

17. The antenna according to claim 4, wherein said distal end portions have a rectangular prismatic configuration and are attached to one another by a straight segment with a uniform section, as a strip, providing surfaces of said parts for attachment of a basal area of the magnetic core.

18. The antenna according to claim 3, wherein the walls of said support portions have a thickness sized to keep the external winding separated a distance from the at least one winding for minimizing stray capacitances and couplings between windings.

19. The antenna according to claim 18, wherein at least one projection made of an electrically insulating material extends in cantilever manner from at least part of an upper free edge of each of said walls in the direction opposite a housing for said magnetic core.

* * * * *